United States Patent [19]

Gillespie et al.

[11] 4,045,026

[45] Aug. 30, 1977

[54] JAI ALAI APPARATUS

[75] Inventors: Richard Lee Gillespie; Arthur Kelso Melin, both of San Gabriel, Calif.

[73] Assignee: Wham-O Mfg. Co., San Gabriel, Calif.

[21] Appl. No.: 622,238

[22] Filed: Oct. 14, 1975

[51] Int. Cl.[2] ..... A63B 65/12

[52] U.S. Cl. ..... 273/96 R; 273/58 B; 273/58 D

[58] Field of Search ..... 124/41 R, 43, 5; 273/58 D, 58 B, 199 R, 199 A, 96 R, 95 R, 67 R, 67 B, 101

[56] References Cited

U.S. PATENT DOCUMENTS

| | | | |
|---|---|---|---|
| 513,560 | 1/1894 | Dickey | 273/58 D |
| 1,178,371 | 4/1916 | Adams | 124/43 |
| 2,025,995 | 12/1935 | Lerch | 273/96 R |
| 2,075,372 | 3/1937 | Taylor | 273/96 R |
| 2,505,090 | 4/1950 | Berry | 273/96 R |
| 2,670,958 | 3/1954 | Leiser | 273/96 R |
| 2,696,204 | 12/1954 | Gilgoff | 124/41 R X |
| 2,935,980 | 5/1960 | Garver | 124/41 R |
| 3,115,129 | 12/1963 | Merriman | 273/96 R |
| 3,366,386 | 1/1968 | Lindholm | 273/67 R |
| 3,539,186 | 11/1970 | Batten | 273/67 R |
| 3,586,329 | 6/1971 | Spreitzer | 273/96 R |
| 3,771,789 | 11/1973 | Kammerl | 273/58 D |
| 3,871,653 | 3/1975 | Sambos | 273/67 B |
| 3,887,184 | 6/1975 | Cavaliere | 273/96 R |

*Primary Examiner*—Anton O. Oechsle
*Assistant Examiner*—Vance Y. Hum
*Attorney, Agent, or Firm*—Christie, Parker & Hale

[57] ABSTRACT

An article in the form of an open framework defining an oblong scoop for throwing, catching and cradling projectiles. The framework of the scoop includes a rim and projectile guide tracks located along the back of the interior of the scoop. The tracks and a top portion of the front face of the rim where the tracks terminate have an uneven surface to enable a user of the article to impart a spin to projectiles.

14 Claims, 12 Drawing Figures

JAI ALAI APPARATUS

BACKGROUND OF THE INVENTION

Jai alai is a game played with a long curved wicker basket strapped to the wrist of a player. The bakset is used to catch and hurl a ball against a wall to make it rebound in such a way that an opponent cannot return it before it is bounced more than once. The jai alai basket is an expensive, hand crafted device requiring a great deal of skill to use. It takes years of training to learn how to skillfully use a jai alai basket because it is difficult to control the flight of the ball when it is thrown with the basket. This is due to the fact that the basket provides no set path for the ball and no direct means for putting a spin on the ball. Thus, unlike a baseball pitcher who imparts spin to a ball and is able to control the path of a ball with his fingers immediately prior to its release, the jai alai player must rely on centrifugal force and a snap of his wrist to control the path of the ball. Thus it is extremely difficult to throw a curve, sinker, or knuckle ball with a jai alai basket.

Another game utilizing a basket or scoop-like device for catching and throwing a ball is lacrosse. The lacrosse stick, also known as a crosse, is a long-handled meshed scoop.

The lacrosse stick suffers from some of the same disadvantages as the jai alai basket. It is difficult to control the path of a thrown ball and takes years of practice to become proficient at it.

Toy makers have sought to capitalize on the popularity of lacrosse and jai alai by manufacturing baskets or scoops patterned after the jai alai basket. One example is a molded polyethylene scoop with a shape comparable to that of the jai alai basket. The scoop has a hollow, cylindrical handle. The front of the scoop is open for catching and throwing balls. The back and sides of the scoop are completely solid. The portion of the scoop near the handle is generally bowl-shaped so that it is possible to hold projectiles in it while running.

Like jai alai and lacrosse baskets, it is difficult to control the path of a projectile thrown by the toy. In addition, the surface area of the back wall of the scoop is relatively small compared to the surface area of the back wall of a lacrosse or jai alai basket. Thus it is difficult to catch a ball with the scoop. Furthermore, since there is no wrist strap and the polyethylene handle is slippery, it is difficult to hold onto in use.

Another toy for catching and throwing balls is a scoop-like implement having a cylindrical, hollow handle with ribs on top of which is a ball cradling area, shaped like a truncated cone, with the smaller end of the cone adjacent to the handle. The back wall of the scoop is an open mesh of rigid ribs of plastic which serves as a backstop for catching balls.

However, the ball catching area is much smaller than the ball catching area of both the lacrosse and jai alai baskets, thereby making it very difficult to catch a ball. In addition, the toy has the same problems that the other prior art devices have, i.e., an unskilled player has a great difficulty in controlling the flight path of a thrown ball.

SUMMARY OF THE INVENTION

In order to overcome the disadvantages of the above devices, I have invented an improved apparatus for throwing, catching and cradling projectiles. This apparatus has a handle with a grooved suface and a flexible wrist strap connected to the handle. There is a projectile cradling section connected to the end of the handle opposite the end with the wrist strap. An elongated scoop for throwing and catching balls is connected to the cradling section. The scoop has an opening at its base which leads to the cradling section, a completely open front, and substantially open sides and back comprised of a mesh like framework.

A rigid frame of thermoplastic material defines the front rim of the scoop. The rim has perpendicular side flanges projecting towards the back of the scoop. The frame includes longitudinally extending projectile guide tracks along the back of the scoop for substantially the entire length of the scoop, with at least a portion of the edge of the tracks facing the mouth of the scoop having a roughened or uneven surface. The frame also has a plurality of concavely arched cross supports perpendicular to and extending between the tracks. There is at least one cross support between each track and the side flange of the rim. The top most portion of the rim in the area where the tracks terminate also has an uneven surface.

In a preferred embodiment, there are two substantially parallel tracks with roughened or texturized surfaces. The distance between the center lines of the tracks is less than the diameter of the ball used with the apparatus, so that the ball sits on the tracks when cradled in the apparatus. The roughened surface comprises a plurality of regularly spaced saw teeth. The uneven surface of the front rim where the track terminates comprises two parallel ridges, triangular in cross section, which extend between the tracks.

The preferred projectile used with this apparatus is a ball with a randomly texturized surface, or a surfach which roughens with use. Preferably, the balls are made from blow molded polyethylene. In another embodiment the ball has a plurality of ribs on its surface which mesh with the teeth on the scoop track.

This apparatus has many advantages. Because there is a wrist strap and the surface of the handle has grooves, it is easy to maintain a firm grip on the apparatus when throwing and catching projectiles. Because the apparatus is made of a thermoplastic material, preferably polypropylene, it is a relatively inexpensive device to fabricate. In addition, polypropylene has the advantage that it is relatively unbreakable, because it flexes rather than cracks when struck. Also, polypropylene has less potential for causing injuries than wooden implements.

The mesh like construction of the scoop helps minimize costs and reduce wind resistance because the scoop is mostly open. Due to the elongated shape of the scoop, there is a large surface area for catching the ball, making it possible for even the relatively unskilled to successfully catch thrown projectiles with this apparatus. Even relatively unskilled players can run and hold a ball without dropping it because there is a cradling section between the handle and the scoop.

With this apparatus it is easy for the unskilled to throw a projectile with a great deal of accuracy. The tracks provide a projectile guide path which defines the direction a projectile flies when thrown. Because the surface of the tracks is uneven, and there is a rough surface on the front face of the rim where the tracks terminate, a spin is imparted to a projectile thrown with this apparatus. Just as a pitcher spins a baseball to cause it to curve, this apparatus enables the thrower to spin the projectile to better control its flight path. With the proper utilization of the spin, it is possible to throw a curve and a sinker.

These and other features, aspects and advantages of the present invention will become more apparent from the following drawings, description, and appended claims.

DRAWINGS

Figure 7:
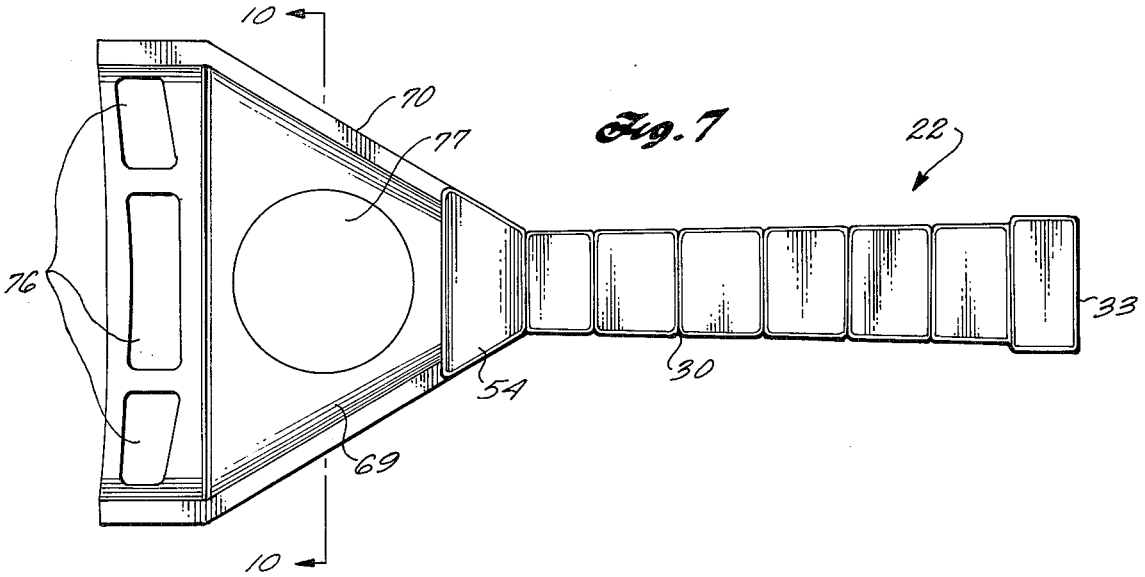
Figure 8:
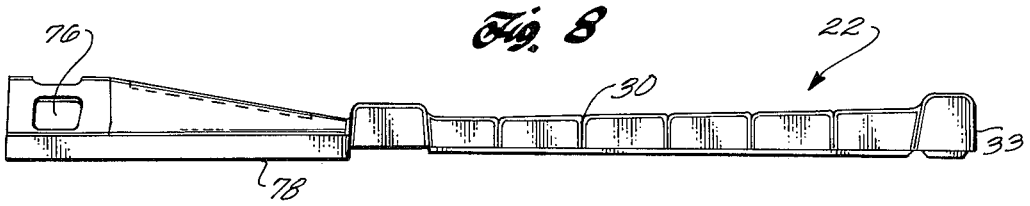
Figure 9:
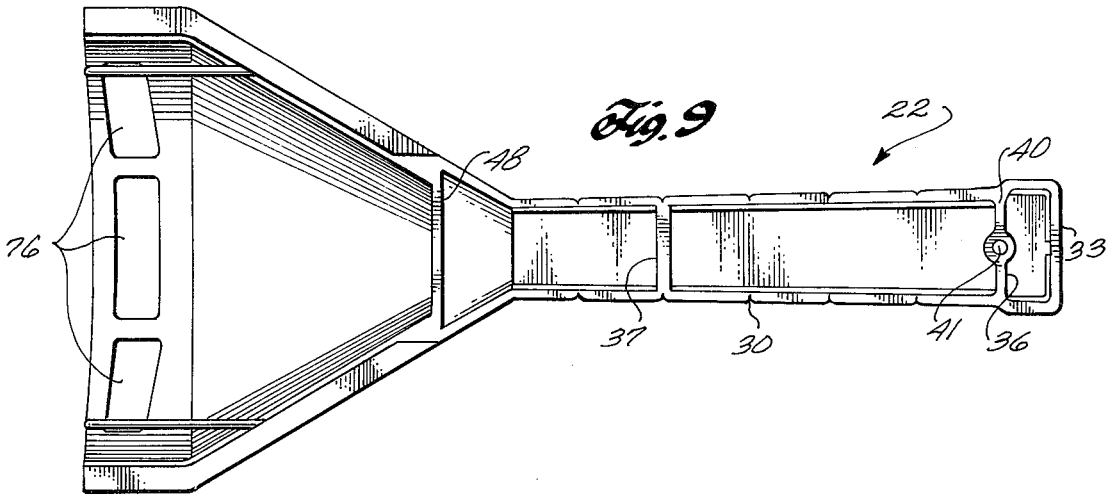
Figure 10:
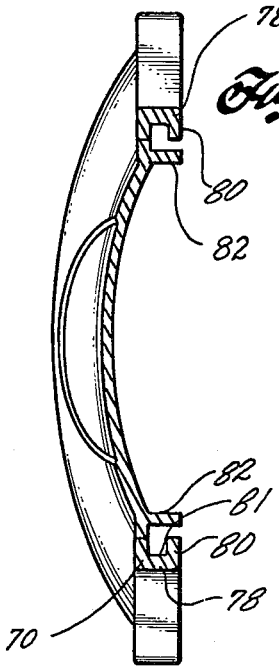
Figure 12:
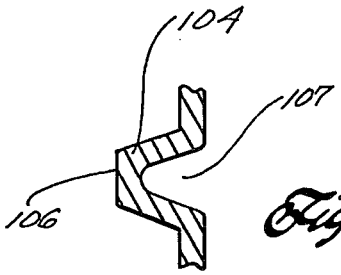
Figure 11:
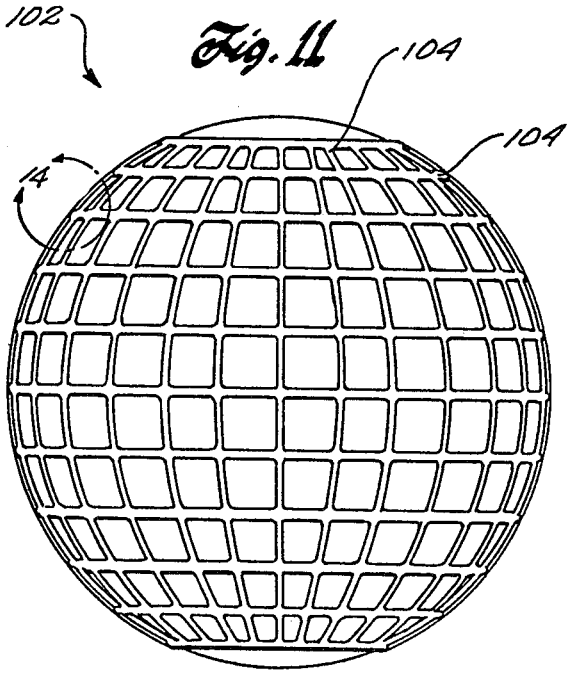

FIG. 7 presents a frontal view of the cover of the handle and ball cradling sections;

FIG. 8 shows a side view of the cover of the handle and ball cradling sections;

FIG. 9 shows a back view of the cover of the handle and ball cradling section;

FIG. 10 is a cross-sectional view of the cover of the ball cradling section along line 10—10 of FIG. 7;

FIG. 11 is an isometric view of a ball suitable for use with this apparatus; and FIG. 12 is a cross-sectional view of a rib of the ball in the area 12 of FIG. 11.

DESCRIPTION OF THE INVENTION

Figure 1:
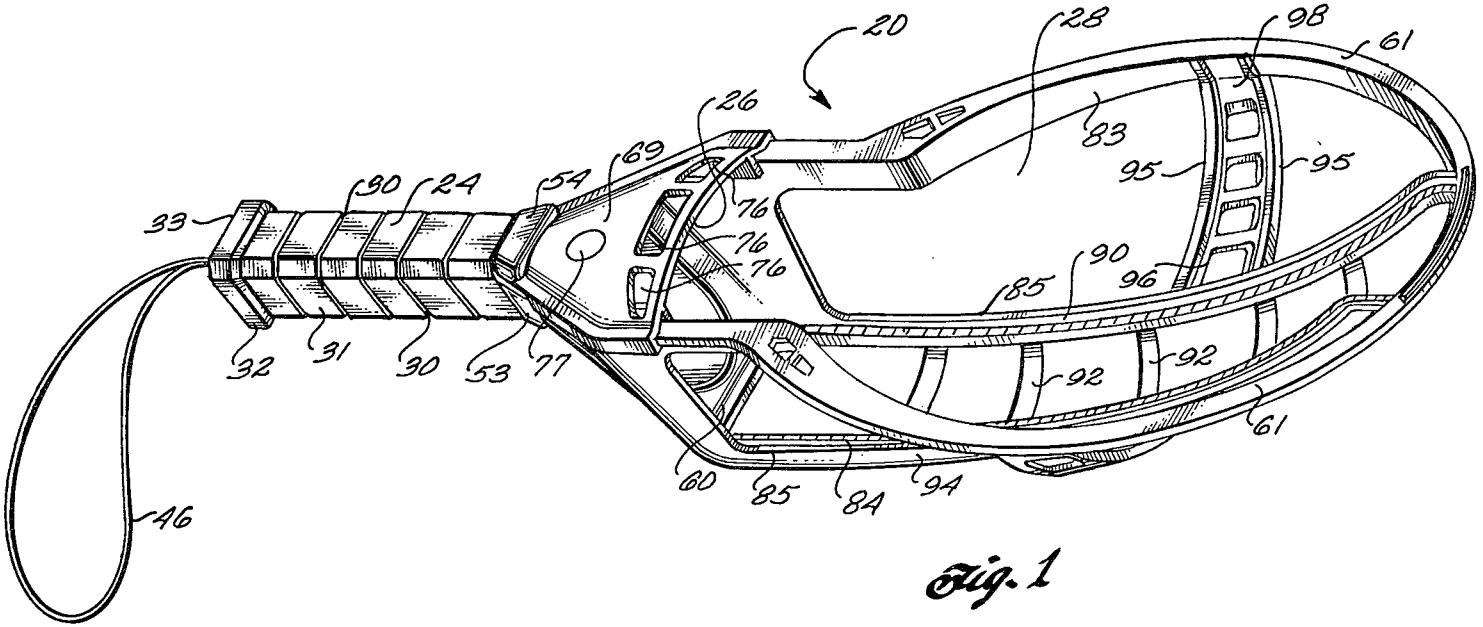
FIG. 1 is an isometric view of an assembled apparatus embodying the features of this invention.
Figure 2:
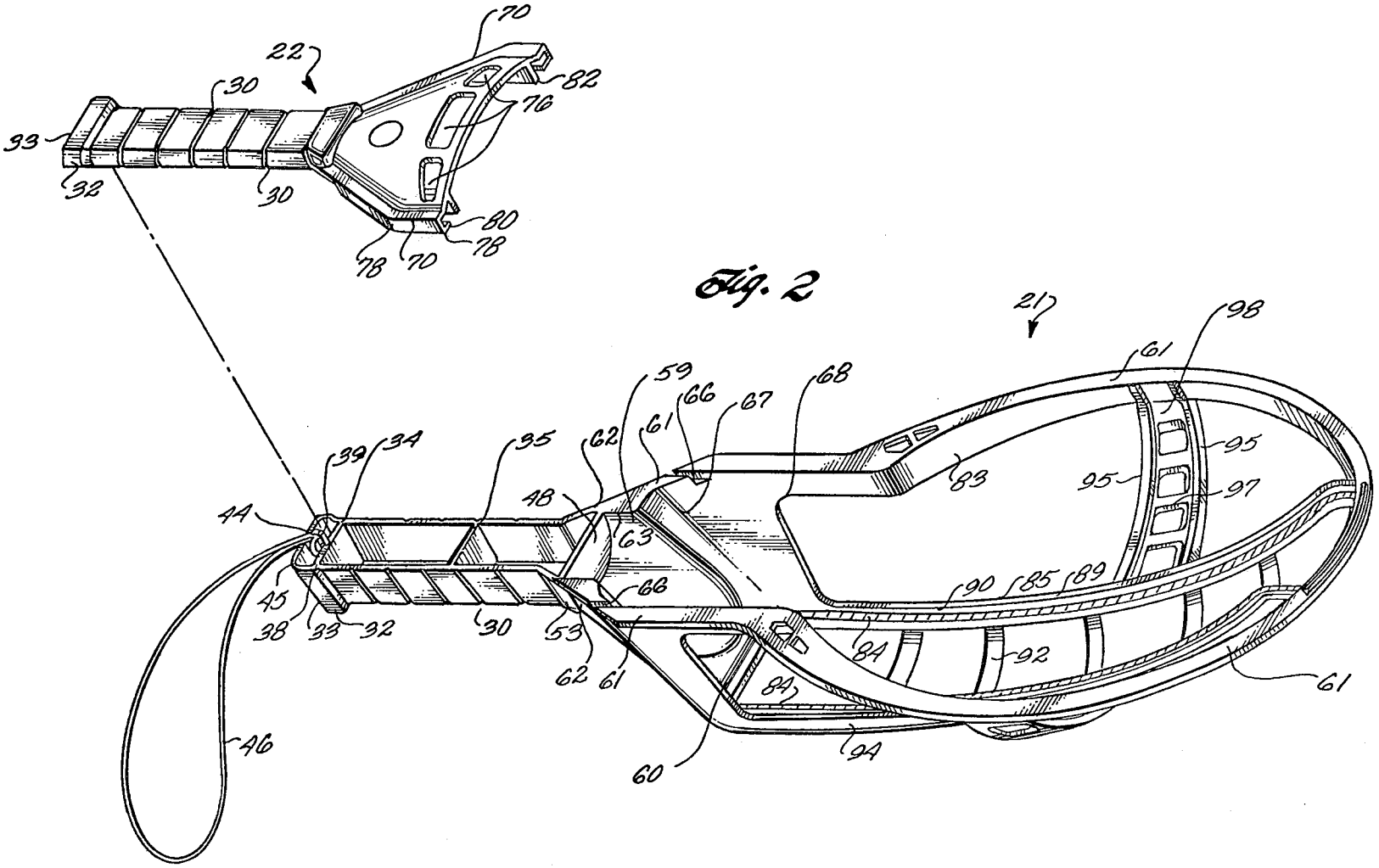
FIG. 2 is an isometric, exploded view of the apparatus of FIG. 1 with the cover of the handle and ball cradling sections separate from the main body of the apparatus.

Referring to FIGS. 1 and 2, an apparatus 20 for catching, throwing and cradling balls is assembled from two parts, a main body 21 and a cover 22 for the front of the handle and projectile cradling sections.

The assembled apparatus comprises three sections which serve distinct functions. There is a handle 24, a projectile cradling section 26, and a projectile catching and throwing section 28.

Referring to FIG. 1, the assembled handle is generally in the shape of an irregular elongated hexahedron. A plurality of parallel grooves 30 circumscribes the outer surface of the handle perpendicular to the handle's major axis. The segment 32 of the handle at its base 33 is larger in cross section than the adjacent section. This prevents the handle from slipping out of a hand when the apparatus is in use.

Figure 3:
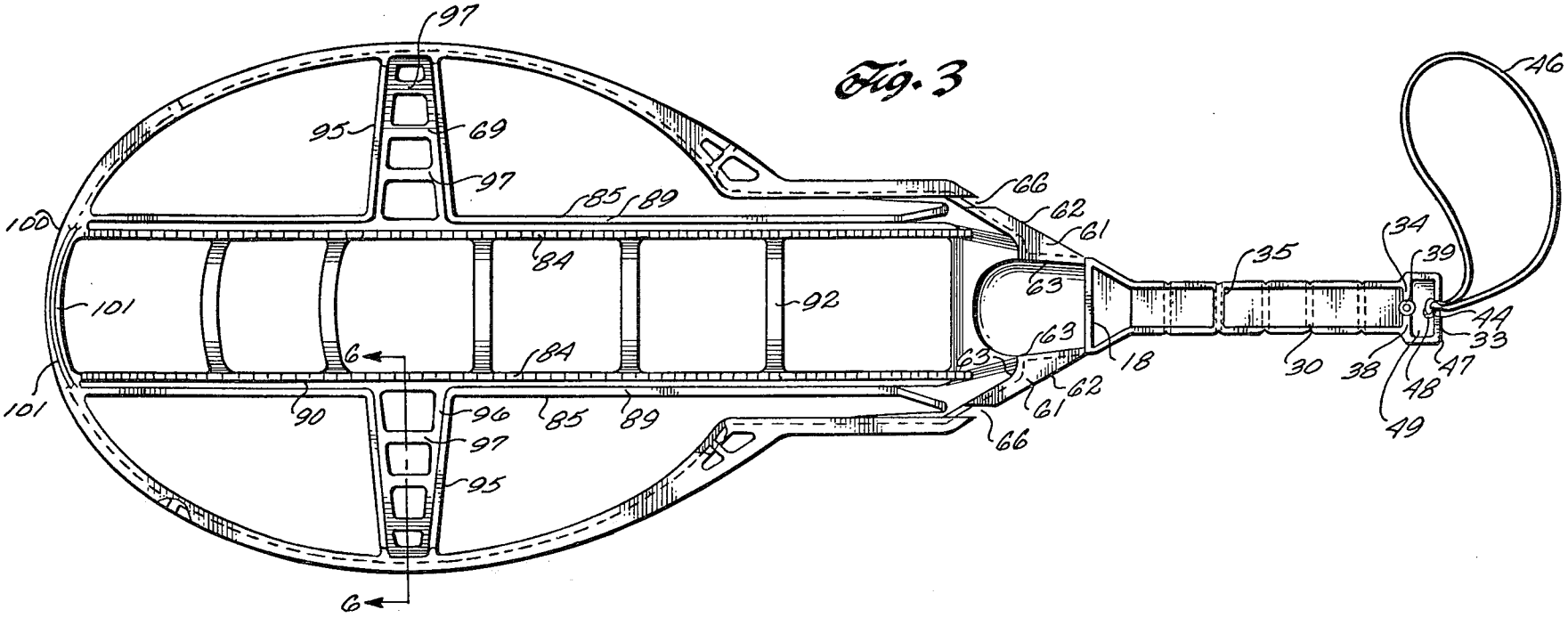
FIG. 3 shows a front view of the main body.

As shown in FIG. 3 the handle is hollow to minimize material costs and the weight of the apparatus. Cross stiffeners serve to keep the handle from being crushed when it is in use. The main body 21 has a cross stiffener 34 at the upper edge of the larger segment 32 at the base 33 of the handle 24 and a cross stiffener 35 about two thirds up the handle. The cover 22 of the handle has corresponding mating cross stiffeners 36,37 (FIG. 9). The front facing surface 38 of the cross stiffener near the base 33 of the handle in the main body of the apparatus has a small cylindrical peg 39 projecting towards the front of the handle. As shown in FIG. 9 the back facing surface 40 of the corresponding cross stiffener 36 in the cover 22 of the handle has a corresponding hole 41 into which the peg 39 fits when the two parts 21,22 of the apparatus are assembled together. Alternatively a screw fastener (not shown) can be used alone or in combination with the peg 39 and hole 41 to secure the two parts 21,22 of the apparatus together when the apparatus is assembled.

Referring to FIG. 3, a slot 44 at the base 33 of the handle is used to attach a wrist strap 46 to the apparatus. The slot is in the frontal edge 47 of the main body 21 at the base 33 of the handle 24. Prior to assembling the two sections 21,22 of the apparatus together, two ends of the wrist strap are tied together in a knot 48 and the knot is slipped into the area 49 between the base 33 of the handle and the cross stiffener 34 nearest the base. The two sides of the strap are slipped into the slot 44. When the apparatus is used, the wrist strap is slipped over the wrist to help a player hold onto the apparatus and throw projectiles.

As shown in FIG. 1, the handle sides 53 adjacent to the projectile cradling section 26 flare out at about a 30° angle. Similarly the front 54 and back 55 surfaces of the handle in this area are raised. Thus this section of the handle at the top acts like the large segment 32 at the base 33 of the handle by helping prevent the handle from flying loose from a slippery hand.

Above the top 48 of the handle is the cup shaped projectile cradling section 26 of the apparatus. This section is formed by the two parts 21,22 comprising the apparatus. The portion formed by the main body 21 of the apparatus will be described first.

Referring to FIG. 2, the back wall of the cradling section 26 comprises a U-shaped section 59, originating at the top 48 of the handle and slanting away from it. The U-shaped section blends into a segment 60 which is generally parallel to the handle top. A front rim 61 defines the perimeter of the cradling section 26. The outer edge of the front rim 61 flares outwardly and away from the top 48 of the handle, thereby forming a truncated "V." The inner edge 63 of the rim 61 initially is perpendicular to the top 68 of the handle, thereby giving a wide section of the rim 61. The inner edge 63 of the top rim curves towards the outer edge 62 and then parallels it. At the end of the flare section the rim extends perpendicularly to the handle top 48.

Referring to FIG. 10, a small side flange 78 extends from the perimeter 70 of the front 22 of the ball cradling section, and a back flange 80 projects from the side flange 78 thereby defining a channel 81. The front rim 61 of the main body 21 fits into the channel 81. This channel 81 helps keep these two parts together when the unit is assembled. A wall 82 parallel to the side flange 78 and set inward from the edge of the back flange 80 fits into the slots 66 in the front rim 61 of the main part 21 when these parts are assembled. This wall 82 serves as a guide and helps secure the two parts together.

Figure 5:
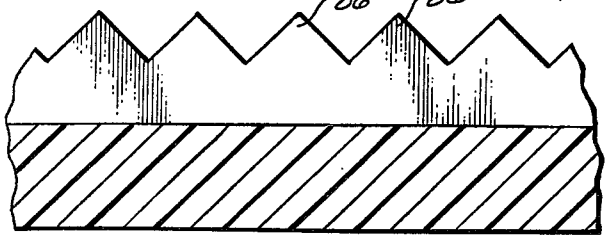
FIG. 5 shows a side view of the projectile guide tracks.

The ball catching and throwing section which is formed by the main body 21 is generally in the configuration of a scoop. It is mostly open area to cut down on wind resistance and the cost of the material. Its periphery is in the shape of an oval with its major axis substantially parallel to the major axis of the handle. The periphery is defined by the front rim. The front rim has a small flange 83 projecting towards the back of the scoop. This flange is the side wall of the scoop. At the back of the scoop there are tracks for substantially the entire length of the scoop. In the embodiment shown in the drawings, there are two sets of tracks which are generally parallel, inner tracks 84 and outer tracks 85. Referring to FIG. 5, the top edge of the inner tracks 84 has a saw tooth surface along its entire length comprising a plurality of regularly spaced adjoining triangles 86. This saw tooth configuration gives the inner track 84 a rough surface, and increases the friction between a projectile and the track. The outer tracks 85, which are useful for cradling large diameter projectiles, have a smooth front surface 89, although this surface also may be roughened.

Figure 6:
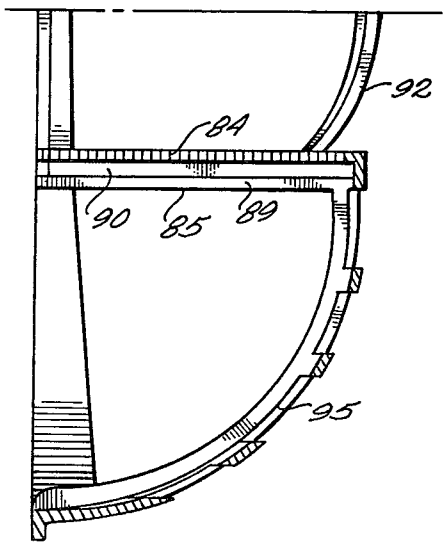
FIG. 6 shows a detailed cross-sectional view of a support track between the side flange along line 6—6 of FIG. 3.

Each inner track 84 is connected to one of the outer tracks 85 along the entire length of the inner track by a back wall 90. The inner tracks are supported by a plurality of concavely arched cross supports 92 connecting the inner tracks. These supports prevent flexing of the tracks. Between the outer side 94 of each of the outer tracks 85 and the side flange 83 of the scoop there are two concavely arched cross supports 95. The supports are shown in detail in FIG. 6. These supports have flanges 96 extending towards each other. Between these flanges 96 there are a plurality of supporting members 97. The section 98 between the side flanges near the front rim 61 is solid to give extra support in this area. This cross rib support system gives the unit rigidity with a minimum amount of material, thereby reducing the material costs and at the same time giving the apparatus sufficient rigidity to adequately control and throw a projectile.

Figure 4:
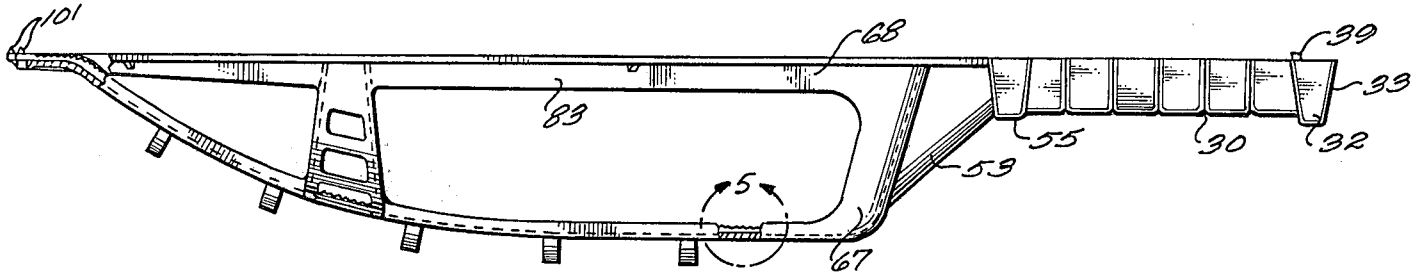
FIG. 4 depicts a side view of the main body.

As shown in FIGS. 1 and 4, the front face 100 of the rim in the area where the tracks 84,85 terminate has two arched parallel ridges 101, triangular in cross section, which extend between the tracks.

The combination of the uneven surface of the tracks and the rough surface on the front face of the rim caused by the ridges imparts a spin to a projectile when it is thrown with this apparatus. It is well known that it is easier to control the flight of a projectile with a spin, and that it is possible to throw a curve, sinker or riser. Thus even for a beginner, use of this apparatus improves control when throwing a ball.

As shown in FIGS. 11 and 12, a ball 102 utilized with this apparatus is a blow molded, hollow sphere with a plurality of equally spaced ridges 104 comparable to the parallels and meridians circling the earth. However, there are not ridges in the pole areas. The ridges are in the shape of truncated cones with tops 106 about half as wide as their bases 107. When the throwing apparatus 20 is used, these ridges engage the teeth 86 of the inner tracks, thereby imparting a spin to the ball when it is thrown.

Preferably, the ball used with the apparatus has a randomly texturized surface or a surface which roughens with use, in order to increase the coefficient of friction between the ball and the tracks. A particularly satisfactory projectile has a surface comprising two random patterns of random ridges, one superimposed on another. Blow molded polyethylene and polypropylene, expanded polystyrene, and Ethafoam are all satisfactory materials. The density of the material used preferably is from about 1 to about 5 pounds per cubic foot. The density of the material does not affect the flight path but it does affect the distance covered by the ball, with the more dense materials travelling further. If a perfectly smooth ball is used, no spin results and the ball acts like a knuckle ball, i.e., it dances when thrown.

Preferably, the catching, cradling, and throwing apparatus is made from injection molded polypropylene because of the low cost of the material, its good forming characteristics, and its low density. Also, polypropylene has a proper balance of rigidity and flexibility so that it is difficult to break. However other materials are suitable such as polyethylene and impact grade polystyrene.

The present invention has been described with reference to a preferred embodiment. However, other versions of this device are equally suitable to practice this invention. For example, the tracks do not have to be parallel. The tracks may converge or diverge, which allows the apparatus to be used with balls of different diameter. In addition, more than two sets of tracks may be used, and the spacing between the outer and inner tracks can be varied to accommodate balls of different diameters. Although it is preferred that the surface of the rough tracks have a saw toothed triangular shape to better engage the ribs on the surface of the ball, any type of roughness such as bumps or ridges can be used to apply a spin to a projectile. In addition, the ridges on the front face of the rim do not necessarily have to be triangular. Any sort of roughening of the surface will accomplish the same effect, such as circular ridges or a series of bumps or high spots.

Because of these variations of the preferred embodiment which are obvious to one skilled in the art, the spirit and scope of the appended claims should not be necessarily limited to the description of the preferred embodiment.

What is claimed is:

1. An apparatus for throwing, catching and cradling projectiles comprising:
   a. handle means with a grooved surface;
   b. strap means attached to the handle;
   c. a projectile cradling section connected to the handle;
   d. an oblong scoop for throwing and catching projectiles connected to the cradling section, the scoop having an opening at its base leading to the cradling section, a completely open front, and substantially open sides and back;
   e. a rigid frame of thermoplastic material defining the perimeter of the scoop comprising:
      i. a rim defining the periphery of the front of the scoop with a perpendicular side flange projecting towards the back of the scoop;
      ii. spherical projectile engaging tracks extending along the back of the scoop for substantially the entire length of the scoop, terminating at the front portion of the rim most remote from the handle, with at last a portion of each of the two tracks having a serrated surface;
      iii. mesh members extending between the rim and the tracks; and
   f. an irregular transverse surface on the front face of the portion of the rim where the tracks terminate whereby when used to launch a spherical projectile, the curvature of the trajectory of the projectile is maximized.

2. An apparatus as claimed in claim 1 wherein the tracks with a serrated surface are substantially parallel.

3. An apparatus a claimed in claim 1 wherein the tracks with a serrated surface have a plurality of triangular saw toothed projections along at least a portion thereof.

4. An apparatus as claimed in claim 1 including a spherical projectile consisting of a hollow ball.

5. An apparatus as claimed in claim 4 wherein the projectile has a plurality of cross ridges consisting of parallels and meridians on its surface.

6. An apparatus as claimed in claim 4 wherein the projectile is fabricated from a material with a density of from about 1 to about 5 pounds per cubic foot.

7. An apparatus as claimed in claim 6 wherein the projectile is fabricated from blow molded polyethylene.

8. An apparatus as claimed in claim 4 wherein the projectile has a randomly texturized surface.

9. An apparatus for throwing, catching, and cradling spherical projectiles comprising:

an oblong receptacle for throwing and catching projectiles, said receptacle having an opening at its base and an open front;

a rigid frame defining the perimeter of the receptacle;

a rim defining the periphery of the front of the receptacle;

a pair of serrated tracks extending along the back of the receptacle for substantially the entire length thereof, said tracks terminating at the end of the receptacle remote from the opening;

an irregular transverse surface on the front face of the rim adjacent the termination point of the tracks;

a projectile cradling section connected to the receptacle at the opening thereof;

handle means connected to the projectile cradling section; and a spherical projectile of a predetermined diameter, said projectile having a roughened surface and being of a preselected diameter such that the spacing of the tracks engages said projectile in both hemispheres whereby a high degree of spin is imparted to the projectile launched by said receptacle to thereby impart a degree of curvature to the trajectory of the projectile corresponding to the degree of spin.

10. A projectile throwing, catching and cradling game apparatus comprising:

a. a projectile having a texturized surface and b. a hand-held implement including:

1. handle means;

2. a cradling section for the projectile connected to the handle means; and 3. a throwing and catching receptacle for the projectile connected to the cradling section, said receptacle comprising a closed loop elongated frame having a pair of tracks located interiorly of the receptacle, the surface of the tracks having a texture to cooperatively engage the surface texture of the projectile, said tracks extending longitudinally of the frame to guide the path and to maximize the spin of the projectile between the cradling section and the end of the frame opposite the cradling section thereby maximizing the curvature of the projectile's trajectory.

11. An apparatus as claimed in claim 10 wherein the texturized surface of the tracks comprises triangular saw toothed projections along at least a portion of the tracks.

12. An apparatus as claimed in claim 10 wherein the face of the frame where the tracks terminate has an uneven surface.

13. An apparatus as claimed in claim 10 wherein the tracks are substantially parallel.

14. An apparatus as claimed in claim 10 wherein the frame and tracks form a scoop for catching and throwing projectiles.

* * * * *